United States Patent [19]

Shimizu et al.

[11] 4,127,698

[45] Nov. 28, 1978

[54] COMPOSITE FIBER

[75] Inventors: Shigeo Shimizu; Akihiko Itoh, both of Yatsushiro, Japan

[73] Assignee: Kohjin Co., Ltd., Tokyo, Japan

[21] Appl. No.: 811,326

[22] Filed: Jun. 29, 1977

[30] Foreign Application Priority Data

Jul. 7, 1976 [JP] Japan ..... 51-79967

[51] Int. Cl.[2] ..... D02G 3/00

[52] U.S. Cl. ..... 428/373; 428/359; 428/364; 428/921

[58] Field of Search ..... 428/359, 357, 364, 373, 428/374, 921; 57/140 BY

[56] References Cited

U.S. PATENT DOCUMENTS

| | | | |
|---|---|---|---|
| 3,763,644 | 10/1973 | Jackson, Jr. et al. | 428/359 X |
| 3,817,779 | 6/1974 | Golborn | 428/921 X |
| 3,870,590 | 3/1975 | Hurwitz | 57/140 BY |
| 3,959,556 | 5/1976 | Morrison | 428/364 |
| 4,035,542 | 7/1977 | Rosenthal et al. | 260/844 X |

FOREIGN PATENT DOCUMENTS

| | | | |
|---|---|---|---|
| 10,823 | 3/1974 | Japan | 428/373 |
| 35,623 | 4/1974 | Japan | 428/373 |

*Primary Examiner*—Lorraine T. Kendell
*Attorney, Agent, or Firm*—Armstrong, Nikaido, Marmelstein & Kubovcik

[57] ABSTRACT

A composite fiber comprising:

(A) 90 to 25 parts by weight of a matrix fiber which comprises as main ingredients a chlorine-containing polymer and a partially acetalized polyvinyl alcohol in a ratio of 40 : 60 to 60 : 40 by weight, and contains a flame-retarding agent in an amount of 1 to 7% by weight based on the total amounts of the main ingredients, said flame-retarding agent comprising (a) stannic acid and/or stannic oxide and (b) antimonic acid and/or antimony oxide and the ratio of the ingredient (a) and the ingredient (b) being 15 : 85 to 50 : 50 by weight, and (B) 10 to 75 parts by weight of at least one fiber selected from the group consisting of polyester fiber, acrylic fiber and cotton fiber. The composite fiber has an excellent flame-retardant property as well as other properties required for common fibers such as good hand touchness and hygroscopicity.

6 Claims, 1 Drawing Figure

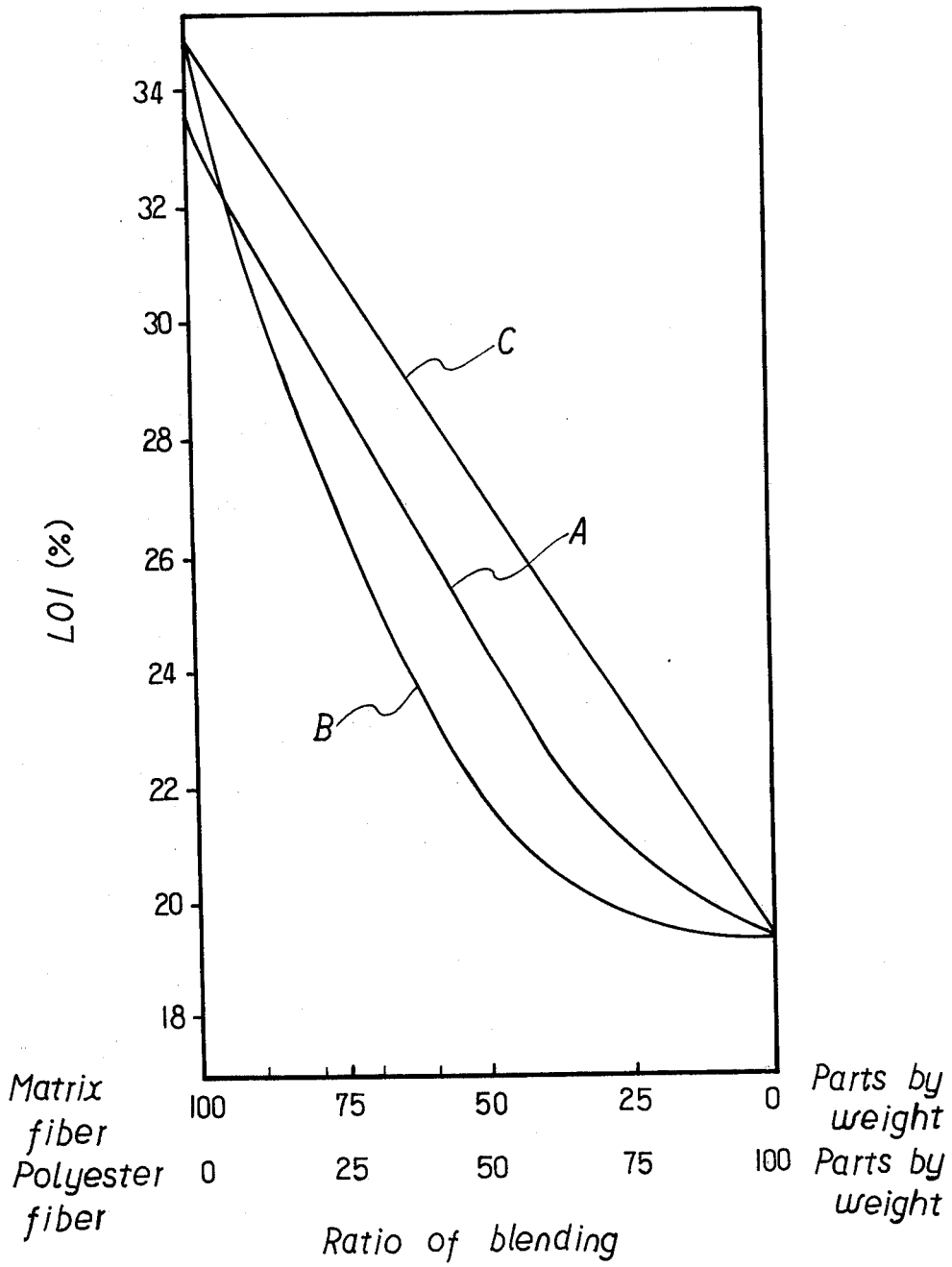
34
32
30
28
26
24
22
20
18
LOI (%)
C
A
B
Matrix fiber
Polyester fiber
100
75
50
25
0
0
25
50
75
100
Parts by weight
Parts by weight
Ratio of blending

COMPOSITE FIBER

BACKGROUND OF THE INVENTION

The present invention relates to a novel composite fiber which is a blend of a specific flame-retardant fiber and at least one common fiber and has an excellent flame-retardant property and other properties required for common fibers such as good hand touchness and hygroscopicity. Particularly, the invention relates to a composite fiber comprising a matrix fiber whch is made of a chlorine-containing polymer and a partially acetalized polyvinyl alcohol as main ingredients and contains as flame-retarding agents a specific tin compound and antimony compound in a specific ratio, and at least one fiber selected from the group consisting of polyester fiber, acrylic fiber and cotton fiber. Hereinafter, the term "matrix fiber" is intended to mean a flame-retardant fiber which is made of a halogen-containing polymer and polyvinyl alcohol as main polymer ingredients. Matrix fiber is also known as "polychlal fiber".

Recently there has been a strong demand for the flame-retardation of fibrous goods such as clothes and interior decorations. Heretofore, researches as to the flame-retardation of fibers have been directed to the flame-retardation of each one kind of fiber such as polyester fiber, acrylic fiber or viscose fiber, and the flame-retardation of composite fibers prepared by blending two or more different kinds of fibers has been researched scarcely.

However, it is almost impossible to produce final products having all properties required by consumers by employing one kind of flame-retardant fiber and therefore it is necessary to blend two or more different kinds of fibers in order to satisfy all properties required. For instance, flame-retardant clothes for children are required to have properties such as superior hand touchness, hygroscopicity, durability and wash and wear property in addition to a superior flame-retardant property. However, it is impossible to satisfy all properties mentioned above by employing only a matrix fiber which is made of polyvinyl chloride (hereinafter referred to as "PVC") and polyvinyl alcohol (hereinafter referred to as "PVA") as main polymer ingredients. For this reason, an attempt to blend the matrix fiber and other fiber such as polyester fiber or cotton fiber was made. However, the present inventors have found out that, in case of blending a flame-retardant fiber and a combustible fiber including the above-mentioned case, the obtained composite fiber does not show any flame-retardant property or, even if it shows some flame-retardant property, the property does not stand at all the provision of DOC-FF 3-71 which is the standard with respect to flame-retardant clothes for children in the United States of America.

The above fact will be explained more clearly in the description hereinafter. In the Japanese Patent applications of the assignee of this application, there is described that a matrix fiber which is made of a halogen-containing polymer and PVA (or acetalized PVA) as main polymer ingredients and contains stannic acid in a specific ratio per the amount of the main polymer ingredients is a durable, highly flame-retardant fiber (see Japanese Patent Publication No. 10823/1974 and Japanese Patent Disclosure No. 35623/1974). Even if the conventional matrix fiber per se has a superior flame-retardant property, the flame-retardant property of a composite fiber prepared by blending the matrix fiber and a polyester fiber is extremely lowered, as compared with that of the matrix fiber per se. That is, it is expected that, even if the flame-retardant property [LOI (Limited Oxygen Index) value] of the composite fiber consisting of the matrix fiber having the composition of chlorine-containing polymer: partially acetalized PVA: stannic acid = 49:51:3 by weight and the polyester fiber is lowered with the increase of the proportion of the polyester fiber, the lowering is proportional to the increase of the proportion of the polyester, as shown by Straight line C in Drawing. However, in fact, the flame-retardant property of the composite fiber is lowered more greatly than expected, as shown by Curve B in Drawing.

As described above, there has never been found out a composite fiber capable of satisfying a flame-retardant property and other properties required by consumers, and the development of such a composite fiber has been demanded strongly.

OBJECTS OF THE INVENTION

An object of the present invention is to provide a novel composite fiber capable of satisfying the flame-retardant property and other properties required by consumers such as hand touchness, hygroscopicity, durability and wash and wear property.

This and other objects of the invention will become apparent from the description hereinafter.

BRIEF DESCRIPTION OF THE DRAWING

The FIGURE is a graph showing the LOI values of composite fibers prepared by blending a matrix fiber having the composition of chlorine-containing polymer: partially acetalized PVA: stannic acid: antimonic acid = 49:51:1:2 by weight (the matrix fiber prepared in Example 2) and a polyester fiber in various ratios (Curve A), the LOI values of composite fibers prepared by blending a conventional matrix fiber having the composition of chlorine-containing polymer: partially acetalized PVA: stannic acid = 49:51:3 by weight (the matrix fiber prepared in Comparative Example) and the polyester fiber in various ratios (Curve B), and the expected LOI values as to composite fibers prepared by blending the conventional matrix fiber of Comparative Example and the polyester fiber in various ratios (Straight Line C).

DETAILED DESCRIPTION

It has been found out that the above-mentioned objects can be accomplished by a composite fiber comprising:

(A) 90 to 25 parts by weight of a matrix fiber which comprises as main ingredients a chlorine-containing polymer and a partially acetalized PVA in a ratio of 40:60 to 60:40 by weight, and contains a flame-retarding agent in an amount of 1 to 7% by weight based on the total amounts of the main ingredients, said flame-retarding agent comprising (a) stannic acid and/or stannic oxide and (b) antimonic acid and/or antimony oxide and the ratio of the ingredient (a) and the ingredient (b) being 15:85 to 50:50 by weight, and (B) 10 to 75 parts by weight of at least one fiber selected from the group consisting of polyester fiber, acrylic fiber and cotton fiber.

The present invention is characterized by employing as the flame-retardant fiber for composite fiber the specific matrix fiber mentioned above. The flame-retardant property of the matrix fiber per se employed in the present invention is not so excellent as that of the conventional matrix fiber per se. However, the specific matrix fiber exhibits a remarkable effect as not expected, when blended with a combustible fiber. That is, when a flame-retardant fiber is blended with a combustible fiber into a composite fiber, the flame-retardant property of the composite fiber is lowered in comparison with that of the flame-retardant fiber per se. However, the lowering of the flame-retardant property of the composite fiber employing the specific matrix fiber is smaller than the lowering of the flame-retardant property of the composite fiber employing the conventional matrix fiber, as shown in Drawing.

The main ingredients of the matrix fiber employed in the present invention are a chlorine-containing polymer and a partially acetalized PVA.

Examples of the chlorine-containing polymer include homopolymers or copolymers of chlorine-containing polymerizable monomers such as vinyl chloride and vinylidene chloride, copolymers of one or more foregoing chlorine-containing polymerizable monomers and one or more other polymerizable monomers such as acrylonitrile, styrene, vinyl acetate, vinyl propionate and acrylic acid esters, and graft polymers in which one or more foregoing chlorine-containing polymerizable monomers are grafted onto PVA or its derivatives. These polymers may be employed alone or in combination. The chlorine-containing polymer preferably has a chlorine content of not less than 20% by weight. The most preferred chlorine-containing polymer is a mixed polymer of a homopolymer or copolymer of one or more foregoing chlorine-containing monomers and a graft polymer in which one or more foregoing chlorine-containing polymerizable monomers are grafted onto PVA or its derivatives. The mixed polymer is prepared by polymerizing one or more foregoing chlorine-containing monomers in the presence of PVA or its derivatives such as PVA having sulfonic acid group in an aqueous medium.

As the partially acetalized PVA, there is preferably employed PVA acetalized by formaldehyde. However, PVA acetalized by acetaldehyde, furfural, glyoxal or benzaldehyde may be employed depending upon the purpose. The degree of acetalization of the partially acetalized PVA is selected from the range of 20 to 45% by mole, particularly 20 to 40% by mole, taking into account the hot water-resistance of the matrix fiber. As the PVA to give the partially acetalized PVA, any conventional PVA may be employed. PVA having a degree of polymerization of 900 to 2,500 and a degree of hydrolysis of not less than 95% by mole is preferably employed. When the mixed polymer prepared by polymerizing the chlorine-containing monomer in the presence of PVA or its derivatives as mentioned above is employed as the chlorine-containing polymer, the partially acetalized PVA is intended to include the acetal of PVA or its derivatives remaining unreacted in the mixed polymer.

It is essential that the ratio of the chlorine-containing polymer and the partially acetalized PVA, which are employed as the main ingredients for the matrix fiber employed in the present invention, is within the range of 40:60 to 60:40 by weight. When the ratio of chlorine-containing polymer is less than the above range, the obtained matrix fiber is unsuitable for the flame-retardant fiber employed in the present invention. When the ratio of the partially acetalized PVA is less than the above range, the obtained matrix fiber extremely lacks the common properties required for common fibers. From this point of view, the preferred ratio of the chlorine-containing polymer and the partially acetalized PVA is within the range of 45:55 to 55:45 by weight.

The flame-retarding agent employed in the present invention is characterized by the combination of a tin compound and an antimony compound. The tin compounds employed are stannic acid and stannic oxide. The term "stannic acid" is intended to indicate stannic oxide hydrate expressed by the chemical formula $SnO_2.XH_2O$ wherein $XH_2O$ is bound water. The stannic acid which has X of 0.5 to 1.5 and is substantially amorphous is preferably employed because it shows an excellent dispersibility in an aqueous spinning dope and does not hinder the stability, filtering property and spinning property of the aqueous spinning dope. Stannic acid is superior to stannic oxide. When stannic acid and stannic oxide are respectively employed at the same amount per the polymer ingredients, the matrix fiber employing stannic acid has better light-resistance and flame-retardant property and lower dullness than the matrix fiber employing stannic oxide. Of course, stannic acid and stannic oxide may be employed alone or in combination. The antimony compounds employed are antimonic acid and antimony oxide which includes diantimony trioxide, diantimony tetroxide and diantimony pentoxide. The term "antimonic acid" is intended to indicate diantimony pentoxide hydrate expressed by the chemical formula $Sb_2O_5.XH_2O$ wherein $XH_2O$ is bound water. The antimonic acid having X of not more than 5 in the chemical formula is preferably employed. Antimonic acid is superior to antimony oxide on the basis of the same reason as in the tin compounds. Of course, antimonic acid and antimony oxide may be employed alone or in combination.

In the flame-retarding agent characterized by the combination of the tin compound and the antimony compound, it is essential that the ratio of the tin compound and the antimony compound is within the range of 15:85 to 50:50 by weight. When the ratio of the tin compound is more than the above range, the LOI value of a composite fiber prepared by blending the obtained matrix fiber with other common fiber is extremely lowered and the flame-retardant property of the composite fiber does not stand the provision of DOC-FF 3-71. When the ratio of the tin compound is less than the above range, the LOI value of the composite fiber is not extremely lowered but the flame-retardant property of the composite fiber also does not stand the provision of DOC-FF 3-71 because a flame tends to remain after an igniting flame is removed in the test provided in DOC-FF 3-71. From this point of view, the preferred ratio of the tin compound and the antimony compound is within the range of 25:75 to 50:50 by weight.

In the matrix fiber employed in the present invention, the above-mentioned flame-retarding agent is incorporated into the main polymer ingredients, i.e. the chlorine-containing polymer and the partially acetalized PVA. It is essential that the content of the flame-retarding agent in the matrix fiber is within the range of 1 to 7%, particularly 2 to 5% by weight based on total amounts of the main polymer ingredients. When the content of the flame-retarding agent is less than the above range, a matrix fiber having the desired flame-retardant property cannot be obtained. When the content of the flame-retarding agent is more than the above range, the common fibrous properties, particularly mechanical property of the obtained matrix fiber are extremely lowered.

The manner of incorporating the flame-retarding agent into the main polymer ingredients is not particularly limited. However, it is preferable to add the flame-retarding agent to a spinning dope when the flame-retardant property of the obtained matrix fiber is required to have such a durability as to stand the provision of DOC-FF 3-71 after fifty times washings.

In addition to the above-mentioned ingredients, there may be employed conventional organic or inorganic auxiliaries, for instance, pigments such as phthalocyanine pigments, stabilizers such as organic tin compounds and amides, modifiers such as modifier for dying property (e.g. polystyrenesulfonic acid) and modifier for heat resistance (e.g. polyacrylamide), delustering agents such as titanium oxide and calcium carbonate.

Usually, the matrix fiber employed in the present invention is obtained by preparing an aqueous spinning dope containing the chlorine-containing polymer, PVA and the flame-retarding agent, and if necessary, auxiliaries, obtaining a fiber from the spinning dope through conventional steps such as spinning, washing, drying, heatstretching and heat-treatment, acetalizing the fiber and subjecting the resultant to conventional finishing works such as oiling.

The chlorine-containing polymer employed in the aqueous spinning dope is usually employed in a form of aqueous emulsion. If the chlorine-containing polymer can be dispersed uniformly into water, it may be employed in a form of powder. As the aqueous emulsion of the chlorine-containing polymer, such a stable aqueous emulsion as described in U.S. Pat. Nos. 3,111,370 and 3,925,290 is most preferably employed. This emulsion is prepared by emulsion-polymerizing the chlorine-containing polymerizable monomer in the presence of PVA or its derivatives such as PVA having sulfonic acid group. The preferred PVA or PVA having sulfonic acid group has a degree of polymerization of 100 to 1,000. The PVA having sulfonic acid group preferably contains 0.5 to 20% by mole of sulfonic acid group. The emulsifying agent and polymerization initiator employed in the emulsion-polymerization are not particularly limited. The preferred emulsifying agents are anionic surface active agents such as sulfates of higher alcohols, alkylarylsulfonates and sodium salts of higher fatty acids. These anionic surface active agents may be employed alone or in combination with each other, or in combination with nonionic surface active agents such as polyethylene glycol alkyl ethers and polyethylene glycol alkylaryl ethers. The preferred polymerization initiators are potassium persulfate, ammonium persulfate, hydrogen peroxide and water-soluble organic peroxides. These polymerization initiators may be alone or in combination with each other, or in combination with reductants such as sodium bisulfite and ferrous chloride. The obtained aqueous emulsion contains as polymer ingredients a homopolymer of the chlorine-containing polymerizable monomer (if two or more kinds of the chlorine-containing polymerizable monomers are employed, a copolymer of these monomers), a graft polymer in which the chlorine-containing polymerizable monomer is grafted onto the PVA or PVA having sulfonic acid group, and unreacted PVA or PVA having sulfonic acid group. The proportion of the homopolymer or copolymer of the chlorine-containing polymerizable monomer, the proportion of the graft polymer and the proportion of the unreacted PVA or PVA having sulfonic acid group are preferably within the ranges of 78 to 90% by weight, of 9 to 20% by weight and of 0.2 to 2% by weight, respectively, based on the total amounts of the polymer ingredients in the aqueous emulsion. The proportion of the whole polymer ingredients is preferably within the range of 25 to 35% by weight based on the amount of the aqueous emulsion. The ratio of the grafting chlorine-containing polymerizable monomer unit and the PVA or PVA having sulfonic acid group in the graft polymer is preferably within the range of 92:8 to 9:91 by weight.

The concentration of the whole polymer ingredients (the chlorine-containing polymer and PVA) in the aqueous spinning dope is preferably within the range of 17 to 26% by weight. The PVA includes the unreacted PVA or PVA having sulfonic acid group when the stable aqueous emulsion mentioned above is employed as the chlorine-containing polymer.

The composite fiber of the present invention is prepared by blending 90 to 25 parts by weight of the above-mentioned matrix fiber with 10 to 75 parts by weight of a polyester fiber, an acrylic fiber or a cotton fiber. When the proportion of the matrix fiber is more than the above range, the properties required for common fibers by consumers, such as stiffness, hand touchness, hygroscopicity, durability and wash and wear property, are insufficient. When the proportion of the matrix fiber is less than the above range, the flame-retardant property is insufficient. The common combustible fibers employed are usually employed alone but may be employed in combination with each other. Examples of the polyester fiber include those available as "Fortrel" (registered trademark of Fiber Industries, Inc.), "Blue C" (registered trademark of Monsanto Textiles Co.), "Toray Tetron" (registered trademark of Toray Industries Inc.) and "Toyobo Ester" (registered trademark of Toyobo Co., Ltd.). Examples of the acrylic fiber include those available as "Cashimilon" (registered trademark of Asahi Chemical Industry Co., Ltd.), "Exlan" (registered trademark of Japan Exlan Company, Ltd.) and "Vonnel" (registered trademark of Mitsubishi Rayon Co., Ltd.). The manner of blending the matrix fiber with the common fiber is not particularly limited. Any conventional method such as fiber blending, mix spinning or yarn blending may be adopted.

The composite fiber of the present invention is suitably utilized as fabrics, knitted goods or non-woven fabrics for clothes, interior decorations and bed clothes, or paddings.

The present invention is more particularly described and explained by means of the following illustrative Examples. In Examples, "parts" means "parts by weight".

EXAMPLE 1

A mixture of 28.2 parts of vinyl chloride, 3.1 parts of vinylidene chloride, 65.8 parts of water and 1.4 parts of a PVA having sulfonic acid group (which was prepared by hydrolyzing a vinylsulfonic acid-vinyl acetate copolymer containing 2% by mole of sodium vinylsulfonate and had a degree of hydrolysis of 98.5% by mole and a degree of polymerization of 350) was polymerized at 45° C. in an autoclave in the presence of 1.4 parts of sodium laurylsulfate and 0.08 part of potassium persulfate to give an aqueous emulsion having an average particle size of 380 A, a viscosity of 10.3 cP and a polymer concentration of 32.1% by weight. The aqueous emulsion contained as main polymer ingredients a copolymer of vinyl chloride and vinylidene chloride and a graft polymer in which vinyl chloride and vinylidene chloride were grafted onto the PVA having sulfonic acid group. The total concentration of the homopolymer of vinyl chloride, the homopolymer of vinylidene chloride and the copolymer of vinyl chloride and vinylidene chloride in the emulsion was 27.8% by weight. The concentration of the graft polymer in the emulsion was 4.2% by weight. The ratio of the grafting vinyl chloride and vinylidene chloride and the PVA unit in the graft polymer was 69:31 by weight.

To 31.6 parts of the aqueous emulsion were added 68.4 parts of a 16% by weight aqueous solution of a PVA (degree of hydrolysis: 99.6% by mole, degree of polymerization: 1,700), 1.2 parts of a 17% by weight aqueous suspension of stannic acid ($SnO_2.1.2H_2O$, average particle size: 0.5$\mu$) and 2.5 parts of a 17% by weight aqueous suspension of antimonic acid ($Sb_2O_5.0.3H_2O$, average particle size: 0.7$\mu$) to give an aqueous spinning dope containing chlorine-containing polymer, PVA, stannic acid and antimonic acid in a ratio of 48:52:1:2 by weight and having a polymer concentration of 20.3% by weight.

The aqueous spinning dope was subjected to a wet emulsion spinning: The dope was extruded from a spinneret having 500 holes into a saturated aqueous solution of sodium sulfate (350 g./liter) at 45° C. The filament obtained was successively subjected to heat-treatment in a saturated aqueous solution of sodium sulfate at 95° C., washing with water, drying at 90° C., stretching at 180° C. and heat-treatment at 225° C. to give a filament having a composition of chlorine-containing polymer:-PVA:stannic acid:antimonic acid = 48:52:1:2 by weight.

The filament was immersed into an acetalizing bath containing 15.5 parts of sulfuric acid, 10 parts of sodium sulfate, 6.5 parts of formaldehyde and 68 parts of water at 70° C. for 40 minutes, so that a degree of acetalization of 36% by mole was achieved. Then the filament was pressed to squeeze off a remaining liquor, washed with a hot water at 40° C., washed with an aqueous solution of sodium carbonate (15 g./liter) at 50° C. and again washed with water. The acetalized filament was subjected to oiling and crimping and cut to give a 2 denier-staple fiber having a length of 54 mm. The staple fiber had a composition of chlorine-containing polymer:partially acetalized PVA:stannic acid:antimonic acid = 47:53:1:2 by weight.

Sixty parts of the staple fiber was blended with 40 parts of a 1.4 denier-polyester fiber (Toyobo Ester) having a length of 51 mm. to give a composite fiber. A single knit having a count of 20/1 and a weight per unit area of 150 g./m.$^2$ was prepared from the composite fiber.

The single knit had a superior flame-retardant property standing the provision of DOC-FF 3-71 and superior hand touchness, hygroscopicity, durability and wash and wear property.

In the foregoing, the average particle size of the emulsion was measured by an electron microscope. The viscosity of the emulsion was measured at 25° C. by a rotary viscometer. The average particle size of stannic acid and antimonic acid was measured by a light-transmission type device for determining particle size distribution by centrifugal sedimentation, with employing as the dispersing agent a 2% by weight aqueous solution of sodium tripolyphosphate.

EXAMPLE 2

A mixture of 32 parts of vinyl chloride, 65 parts of water and 2 parts of a PVA (degree of hydrolysis: 99.0% by mole, degree of polymerization: 500) was polymerized at 45° C. in an autoclave in the presence of 0.9 part of sodium laurylsulfate and 0.07 part of potassium persulfate to give an aqueous emulsion having an average particle size of 300 A, a viscosity of 15 cP and a polymer concentration of 32.9% by weight. The aqueous emulsion contained as main polymer ingredients a homopolymer of vinyl chloride and a graft polymer in which vinyl chloride was grafted onto the PVA. The concentration of the homopolymer of vinyl chloride in the emulsion was 28.7% by weight. The concentration of the graft polymer in the emulsion was 4.0% by weight. The ratio of the grafting polyvinyl chloride unit and the PVA unit in the graft polymer was 56:44 by weight.

To 33.1 parts of the aqueous emulsion were added 66.9 parts of a 16% by weight aqueous solution of a PVA (degree of hydrolysis: 99.8% by mole, degree of polymerization: 1,650), 1.3 parts of a 17% by weight aqueous suspension of stannic acid ($SnO_2.1.0H_2O$, average particle size: 0.5$\mu$) and 2.7 parts of a 16% by weight aqueous suspension of antimonic acid ($Sb_2O_5.0.5H_2O$, average particle size: 0.6$\mu$) to give an aqueous spinning dope containing chlorine-containing polymer, PVA, stannic acid and antimonic acid in a ratio of 50:50:1:2 by weight and having a polymer concentration of 20.8% by weight.

The aqueous spinning dope was extruded and the obtained filament was after-treated in the same manner as in Example 1 to give a filament having a composition of chlorine-containing polymer:PVA:stannic acid:antimonic acid = 50:50:1:2 by weight. The filament was subjected to the same acetalizing, oiling and crimping treatments as in Example 1 and cut to give a 2 denier-staple fiber having a length of 51 mm. The staple fiber had a composition of chlorine-containing polymer:partially acetalized PVA:stannic acid:antimonic acid = 49:51:1:2 by weight.

The staple fiber (matrix fiber) was blended with the same polyester fiber as employed in Example 1 in the proportions as described in Table 1 to give six kinds of composite fibers. As to the composite fibers, LOI value was determined. The results thereof are shown in Table 1.

Table 1

| | | | | | | |
|---|---|---|---|---|---|---|
| Matrix fiber of Example 2 (parts) | 100 | 90 | 75 | 50 | 25 | 0 |
| Polyester fiber (parts) | 0 | 10 | 25 | 50 | 75 | 100 |
| LOI | 33.6 | 31.5 | 29.1 | 24.6 | 21.0 | 19.3 |

COMPARATIVE EXAMPLE

By employing the aqueous emulsion containing the PVC as the chlorine-containing polymer, the PVA aqueous solution and the stannic acid aqueous suspension employed in Example 2, there was obtained an aqueous spinning dope containing chlorine-containing polymer, PVA and stannic acid in a ratio of 50:50:3 by weight.

The aqueous spinning dope was extruded and the obtained filament was after-treated in the same manner as in Example 1 to give a filament having a composition of chlorine-containing polymer:PVA:stannic acid =

50:50:3 by weight. The filament was subjected to the same acetalizing, oiling and crimping treatments as in Example 1 and cut to give a 2 denier-staple fiber having a length of 51 mm. The staple fiber had a composition of chlorine-containing polymer:partially acetalized PVA:-stannic acid = 49:51:3 by weight.

The staple fiber (matrix fiber) was blended with the same polyester fiber as employed in Example 1 in the proportions described in Table 2 to give six kinds of composite fibers. As to the composite fibers, LOI value was determined. The results thereof are shown in Table 2.

Table 2

| | | | | | | |
|---|---|---|---|---|---|---|
| Matrix fiber of Comparative Example (parts) | 100 | 90 | 75 | 50 | 25 | 0 |
| Polyester fiber (parts) | 0 | 10 | 25 | 50 | 75 | 100 |
| LOI | 34.9 | 30.9 | 26.9 | 21.8 | 19.9 | 19.3 |

The results of Table 1 and Table 2 are illustrated in Drawing. In Drawing, Curve A shows the LOI values of the composite fibers obtained in Example 2, Curve B shows the LOI values of the composite fibers obtained in Comparative Example, and Straight line C shows the expected LOI values as to the composite fibers obtained in Comparative Example.

As is clear from Drawing, the matrix fiber per se employed in the present invention (Example 2) has a poorer flame-retardant property than the conventional matrix fiber per se (Comparative Example). However, when blended with the polyester fiber into composite fiber, the matrix fiber employed in the present invention shows a smaller lowering of flame-retardant property than the conventional matrix fiber.

EXAMPLE 3

The similar manner as in Example 2 was repeated to give six kinds of 2 denier-staple fibers having a length of 51 mm. The staple fibers had a composition of chlorine-containing polymer:partially acetalized PVA:(stannic acid + antimonic acid) = 47:53:3 by weight and contained stannic acid and antimonic acid in the various ratios shown in Table 3.

Sixty parts of the obtained each staple fiber was blended with 40 parts of the same polyester fiber as employed in Example 1 to give six kinds of composite fibers.

As to the staple fibers (matrix fiber) and the composite fibers, LOI value was determined. From the obtained LOI values, lowering ratio of LOI expressed by the following formula was calculated.

$$\text{Lowering ratio of LOI (\%)} = \frac{\text{LOI of matrix fiber} - \text{LOI of composite fiber}}{\text{LOI of matrix fiber}} \times 100$$

From the composite fibers, six kinds of single knits having a count of 9/1 and a weight per unit area of 250 g./m.$^2$ were obtained. The single knits were subjected to the flame-retardant test provided in DOC-FF 3-71.

The results thereof are shown in Table 3.

Table 3

| | | | | | | | |
|---|---|---|---|---|---|---|---|
| Stannic acid (% by weight) | | 5 | 17 | 33 | 50 | 67 | 83 |
| Antimonic acid (% by weight) | | 95 | 83 | 67 | 50 | 33 | 17 |
| Lowering ratio of LOI (%) | | 16.7 | 21.8 | 22.3 | 24.7 | 26.1 | 27.8 |
| DOC-FF 3-71 | Before washing | X | ○ | ○ | ○ | X | X |
| | After 50 times washings | X | ○ | ○ | ○ | X | X |

In Table 3, the symbol ○ means that the flame-retardant property of the single knit stands the provision of DOC-FF 3-71 and the symbol means that the flame-retardant property of the single knit does not stand the provision of DOC-FF 3-71. This applies to Examples hereinafter.

As is clear from Table 3, the lowering ratio of LOI becomes greater with increasing the proportion of stannic acid in the flame-retarding agent and, when the proportion of stannic acid is more than 50% by weight, the flame-retardant property does not stand the provision of DOC-FF 3-71. When the proportion of stannic acid is less than 15% by weight, the flame-retardant property also does not stand the provision of DOC-FF 3-71 because a remaining flame tends to remain. To the contrary, when the ratio of stannic acid and antimonic acid is within the scope of the present invention (17:83, 33:67 and 50:50 by weight), the flame-retardant property is so durable that it stands the provision of DOC-FF 3-71 after fifty times washings and the other properties such as hand touchness and hygroscopicity are also good.

EXAMPLE 4

The similar manner as in Example 2 was repeated to give three kinds of 2 denier-staple fibers having a length of 51 mm. The staple fibers had a composition of chlorine-containing polymer:partially acetalized PVA:(stannic acid + antimonic acid) = 49:51:3 by weight and contained stannic acid and antimonic acid in the proportions shown in Table 4.

Seventy parts of the obtained each staple fiber was blended with 30 parts of a 2 denier-acrylic fiber (Cashimilon) having a length of 51 mm. to give three kinds of composite fibers.

As to the staple fibers and the composite fibers, LOI value was determined. From the obtained LOI values, lowering ratio of LOI was calculated.

From the composite fibers, three kinds of single knits having a count of 20/1 and a weight per unit area of 150 g./m.$^2$ were obtained. The single knits were subjected to the flame-retardant test provided in DOC-FF 3-71.

The results thereof are shown in Table 4.

Table 4

| | | | |
|---|---|---|---|
| Stannic acid (parts) | 0 | 1 | 3 |
| Antimonic acid (parts) | 3 | 2 | 0 |
| Lowering ratio of LOI (%) | 12.3 | 21.6 | 27.8 |
| DOC-FF 3-71 | X | ○ | X |

As is clear from Table 4, when only stannic acid is employed as the flame-retarding agent, the lowering ratio of LOI is great and the flame-retardant property of the composite fiber does not stand the provision of DOC-FF 3-71. When only antimonic acid is employed as the flame-retarding agent, the lowering ratio of LOI is small but the flame-retardant property of the composite fiber does not stand the provision of DOC-FF 3-71 because a remaining flame tends to remain. To the contrary, when stannic acid and antimonic acid are employed in a ratio within the scope of the present invention (1:2 by weight), the flame-retardant property of the composite fiber is excellent. The common fibrous properties other than the flame-retardant property, particularly hand touchness and hygroscopicity, are also excellent.

EXAMPLE 5

Sixty five parts of each staple fiber obtained in Example 4 was blended with 35 parts of a cotton fiber to give three kinds of composite fibers.

From the LOI values of the staple fibers and the LOI values of the composite fibers, lowering ratio of LOI was calculated.

From the composite fibers, three knids of single knit having a count of 20/1 and a weight per unit area of 150 g./m.$^2$ were obtained. The single knits were subjected to the flame-retardant test provided in DOC-FF 3-71.

The results thereof are shown in Table 5.

Table 5

| | | | |
|---|---|---|---|
| Stannic acid (parts) | 0 | 1 | 3 |
| Antimonic acid (parts) | 3 | 2 | 0 |
| Lowering ratio of LOI (%) | 21.8 | 27.5 | 33.3 |
| DOC-FF 3-71 | X | ○ | X |

As is clear from Table 5, when only stannic acid is employed as the flame-retarding agent, the lowering ratio of LOI is great and the flame-retardant property of the composite fiber does not stand the provision of DOC-FF 3-71. When only antimonic acid is employed as the flame-retarding agent, the lowering ratio of LOI is small but the flame-retardant property of the composite fiber does not stand the provision of DOC-FF 3-71 because a remaining flame tends to remain. To the contrary, when stannic acid and antimonic acid are employed in a ratio within the scope of the present invention (1:2 by weight), the flame-retardant property of the composite fiber is excellent.

EXAMPLE 6

The similar manner as in Example 2 was repeated to give a 2 denier-staple fiber having a length of 51 mm. and a composition of chlorine-containing polymer:partially acetalized PVA:stannic oxide:diantimony trioxide = 49:51:1:2 by weight.

Fifty parts of the staple fiber was blended with 50 parts of the same polyester fiber as employed in Example 1 to give a composite fiber.

The LOI value of the composite fiber was 24.0. The composite fiber had a better flame-retardant property than the composite fiber of Comparative Example which employed the conventional matrix fiber containing only stannic acid as the flame-retarding agent.

What we claim is:

1. A composite fiber comprising:

(A) 90 to 25 parts by weight of a matrix fiber which comprises as main ingredients a chlorine-containing polymer and a partially acetalized polyvinyl alcohol in a ratio of 40:60 to 60:40 by weight, and contains a flame-retarding agent in an amount of 1 to 7% by weight based on the total amounts of the main ingredients, said flame-retarding agent comprising (a) at least one of stannic acid and stannic oxide and (b) at least one of antimonic acid and antimony oxide and the ratio of the ingredient (a) and the ingredient (b) being 15:85 to 50:50 by weight; the chlorine-containing polymer being at least one member selected from the group consisting of homopolymer or copolymer of at least one of vinyl chloride and vinylidene chloride; copolymer of at least one of vinyl chloride and vinylidene chloride, and at least one of acrylonitrile, styrene, vinyl acetate, vinyl propionate and acrylic acid esters; and graft polymer in which at least one of vinyl chloride and vinylidene chloride are grafted onto polyvinyl alcohol or polyvinyl alcohol having sulfonic acid group, and (B) 10 to 75 parts by weight of at least one fiber selected from the group consisting of polyester fiber, acrylic polymer fiber and cotton fiber.

2. The composite fiber of claim 1, wherein the ratio of the ingredient (a) and the ingredient (b) in the flame-retarding agent is 25:75 to 50:50 by weight.

3. The composite fiber of claim 1, wherein the flame-retarding agent consists of stannic acid and antimonic acid.

4. The composite fiber of claim 1, wherein the matrix fiber contains the flame-retarding agent in an amount of 2 to 5% by weight based on the total amounts of the main ingredients.

5. The composite fiber of claim 1, wherein the matrix fiber comprises as the main ingredients the chlorine-containing polymer and partially acetalized polyvinyl alcohol in a ratio of 45:55 to 55:45 by weight.

6. The composite fiber of claim 1 wherein said chlorine containing polymer has a chlorine content of at least 20% by weight.

* * * * *